US011220778B2

(12) United States Patent
Saponaro

(10) Patent No.: US 11,220,778 B2
(45) Date of Patent: Jan. 11, 2022

(54) APPLIANCE COMPRISING A WATER INLET MODULE

(71) Applicant: Electrolux Appliances Aktiebolag, Stockholm (SE)

(72) Inventor: Andrea Saponaro, Porcia (IT)

(73) Assignee: Electrolux Appliances Aktiebolag

( * ) Notice: Subject to any disclaimer, the term of this patent is extended or adjusted under 35 U.S.C. 154(b) by 0 days.

(21) Appl. No.: 16/477,352

(22) PCT Filed: Dec. 21, 2017

(86) PCT No.: PCT/EP2017/084194

§ 371 (c)(1),
(2) Date: Jul. 11, 2019

(87) PCT Pub. No.: WO2018/130404

PCT Pub. Date: Jul. 19, 2018

(65) Prior Publication Data

US 2019/0374086 A1 Dec. 12, 2019

(30) Foreign Application Priority Data

Jan. 12, 2017 (EP) ..... 17151126

(51) Int. Cl.
*D06F 39/08* (2006.01)
*D06F 39/02* (2006.01)
(Continued)

(52) U.S. Cl.
CPC ..... *D06F 39/088* (2013.01); *A47L 15/4214* (2013.01); *A47L 15/4418* (2013.01);
(Continued)

(58) Field of Classification Search
CPC .... D06F 39/022; D06F 39/081; D06F 39/083; D06F 39/088; D06F 39/087; D06F 33/34;
(Continued)

(56) References Cited

U.S. PATENT DOCUMENTS 2,434,353 A 1/1948 Edwards
2,472,665 A 6/1949 Ladner
(Continued)

FOREIGN PATENT DOCUMENTS

CN 1552635 A 12/2004
CN 101029446 A 9/2007
(Continued)

OTHER PUBLICATIONS

Oxford English Dictionary, entry for "module", available at https://www.oed.com/view/Entry/120688 (Year: 2021).*
(Continued)

*Primary Examiner* — Mikhail Kornakov
*Assistant Examiner* — Richard Z. Zhang
(74) *Attorney, Agent, or Firm* — RatnerPrestia

(57) ABSTRACT

An appliance having: a control unit managing the operation of the appliance; at least one hydraulic component actionable for distributing water/treating liquids within the appliance; a plurality of sensors arranged for acquiring information regarding physical parameters associated with the operation of the appliance, and a module managing at least part of the water/treating liquids distribution within the appliance. The module includes the at least one hydraulic component; at least two sensors of the plurality of sensors, and a local control unit managing the operation of the at least one hydraulic component and/or receiving the information acquired by the at least two sensors.

22 Claims, 7 Drawing Sheets

(51) Int. Cl.

| | |
|---|---|
| ***A47L 15/42*** | (2006.01) |
| ***A47L 15/44*** | (2006.01) |
| ***D06F 33/34*** | (2020.01) |
| *D06F 103/14* | (2020.01) |
| *D06F 103/20* | (2020.01) |
| *D06F 105/04* | (2020.01) |
| *D06F 105/52* | (2020.01) |

(52) U.S. Cl.
CPC ..... *D06F 33/34* (2020.02); *D06F 39/02* (2013.01); *D06F 39/081* (2013.01); *D06F 2103/14* (2020.02); *D06F 2103/20* (2020.02); *D06F 2105/04* (2020.02); *D06F 2105/52* (2020.02)

(58) Field of Classification Search
CPC ..... D06F 33/37; D06F 33/08; D06F 33/22; D06F 33/24; D06F 1/00–95/008; D06F 39/02–028; D06F 39/08–088; D06F 33/57; D06F 34/08; D06F 34/143; D06F 4/22; D06F 34/24; D06F 2103/22; D06F 2105/02–04; D06F 2204/088; D06F 33/47; D06F 33/74; D06F 34/14; D06F 34/22; D06F 37/42; H05K 5/065; H05K 5/00–069; H05K 7/14–186; A47L 15/44; A47L 15/4214; A47L 15/4418; A47L 2401/02; A47L 2401/09; A47L 2401/14; A47L 2501/01
See application file for complete search history.

(56) References Cited

U.S. PATENT DOCUMENTS

| | | | | |
|---|---|---|---|---|
| 2,907,844 | A | 10/1959 | Lindsey | |
| 4,710,853 | A * | 12/1987 | Reinhardt | H05K 7/1425 361/727 |
| 6,557,382 | B1 | 5/2003 | Koike et al. | |
| 6,823,878 | B1 | 11/2004 | Gadini | |
| 10,012,971 | B2 | 7/2018 | Pietsch et al. | |
| 2002/0116960 | A1 | 8/2002 | Nakada | |
| 2005/0182568 | A1 | 8/2005 | Duraffourd et al. | |
| 2006/0048571 | A1 | 3/2006 | Lee | |
| 2006/0081016 | A1* | 4/2006 | Hsu | D06F 39/022 68/12.18 |
| 2006/0107705 | A1 | 5/2006 | Hsu et al. | |
| 2007/0142931 | A1 | 6/2007 | Peral | |
| 2009/0120135 | A1* | 5/2009 | Gill | D06F 39/08 68/12.05 |
| 2009/0194562 | A1* | 8/2009 | Kessler | A47L 15/0055 222/1 |
| 2010/0000027 | A1 | 1/2010 | Bae et al. | |
| 2011/0056250 | A1 | 3/2011 | Kim | |
| 2012/0058025 | A1* | 3/2012 | Fienup | A47L 15/44 422/261 |
| 2013/0047678 | A1 | 2/2013 | Lee et al. | |
| 2014/0157835 | A1* | 6/2014 | Del Pos | D06F 39/00 68/17 R |
| 2014/0157836 | A1 | 6/2014 | Zattin et al. | |
| 2014/0165665 | A1 | 6/2014 | Del Pos et al. | |
| 2014/0165666 | A1 | 6/2014 | Del Pos et al. | |
| 2014/0250607 | A1* | 9/2014 | Favaro | D06F 35/006 8/137 |
| 2015/0017309 | A1 | 1/2015 | Pope-Mayell et al. | |
| 2015/0107309 | A1 | 4/2015 | Favaro et al. | |
| 2015/0107310 | A1 | 4/2015 | Del Pos et al. | |
| 2015/0204005 | A1 | 7/2015 | Favaro et al. | |
| 2015/0346018 | A1 | 12/2015 | Manivannan | |
| 2016/0010266 | A1 | 1/2016 | Del Pos et al. | |
| 2017/0163437 | A1 | 6/2017 | Yang et al. | |
| 2018/0073187 | A1* | 3/2018 | Li | D06F 37/225 |
| 2018/0148881 | A1* | 5/2018 | Alexander | D06F 33/00 |

FOREIGN PATENT DOCUMENTS

| | | | |
|---|---|---|---|
| CN | 200975969 | Y | 11/2007 |
| CN | 201648060 | U | 11/2010 |
| CN | 202329748 | U | 7/2012 |
| CN | 105278498 | A | 1/2016 |
| CN | 105518548 | A | 4/2016 |
| DE | 1642445 | A1 | 4/1971 |
| DE | 3131543 | A1 | 2/1983 |
| DE | 3703254 | A1 | 8/1988 |
| DE | 3710511 | A1 | 10/1988 |
| DE | 3736311 | A1 | 5/1989 |
| DE | 4004057 | A1 | 8/1991 |
| DE | 4313539 | A1 | 10/1994 |
| DE | 4343539 | C2 | 7/1996 |
| DE | 10204002 | A1 | 8/2003 |
| EP | 1085118 | A2 | 3/2001 |
| EP | 1087052 | A2 | 3/2001 |
| EP | 1211491 | A1 | 6/2002 |
| EP | 2251481 | A1 | 11/2010 |
| EP | 2295625 | A1 | 3/2011 |
| EP | 2554736 | A1 | 2/2013 |
| EP | 2562303 | A2 | 2/2013 |
| EP | 2578736 | A1 | 4/2013 |
| EP | 2656771 | A1 | 10/2013 |
| EP | 2657387 | A1 | 10/2013 |
| EP | 3095907 | A1 | 11/2016 |
| FR | 2438016 | A1 | 4/1980 |
| FR | 2829579 | A1 | 3/2003 |
| JP | 07270214 | A1 | 10/1995 |
| JP | 11244580 | A | 9/1999 |
| WO | 2014121820 | A1 | 8/2014 |

OTHER PUBLICATIONS

Dictionary.com, entry for "module," available at https://www.dictionary.com/browse/module (Year: 2021).*
New Oxford American Dictionary, entry for "module," (3rd ed. Oxford University Press) (Year: 2010).*
Cambridge English Dictionary, entry for "module", available at https://dictionary.cambridge.org/us/dictionary/english/module (Year: 2021).*
International Search Report and Written Opinion for International Application No. PCT/EP2017/084194, dated Mar. 23, 2018, 11 pages.
Final Office Action for U.S. Appl. No. 16/084,412, dated Oct. 13, 2020, 25 pages.
Chinese Office Action for Chinese Application No. 201680083496.0, dated Jul. 29, 2020, 10 pages.
International Search Report and Written Opinion for International Application No. PCT/EP2016/056551, dated Jun. 1, 2016, 12 pages.
Non Final Office Action for U.S. Appl. No. 16/084,412, dated Jul. 7, 2020, 18 pages.
Chinese Office Action for Chinese Application No. 201780078492.8, dated Dec. 24, 2020, 12 pages.
Non Final Office Action for U.S. Appl. No. 16/084,412, dated Jan. 8, 2021, 20 pages.
Chinese Office Action for Chinese Application No. 201680083446.2, dated Jun. 30, 2020 with translatiojn, 20 pages.
International Search Report and Written Opinion for International Application No. PCT/EP2016/056550, dated May 31, 2016, 11 pages.
Notice of Allowance for U.S. Appl. No. 16/084,412, dated Apr. 2, 2021, 18 pages.
Chinese Office Action for Chinese Application No. 201780078492.8, dated Jun. 21, 2021, 8 pages.
Final Office Action for U.S. Appl. No. 16/085,822, dated Aug. 9, 2021, 32 pages.

* cited by examiner

APPLIANCE COMPRISING A WATER INLET MODULE

This application is a U.S. National Phase application of PCT International Application No. PCT/EP2017/084194, filed Dec. 21, 2017, which claims the benefit of EP 17151126.4, filed Jan. 12, 2017, both of which are incorporated by reference herein.

FIELD OF THE INVENTION

The present invention generally relates to appliances both for domestic and professional purposes. In detail, the present invention refers to household appliances that comprise a water inlet module arranged for managing the operation of one or more hydraulic components of the appliance.

BACKGROUND OF THE INVENTION

Appliances of any typology (e.g., dishwashers, laundry machines, refrigerators, ovens, etc.) generally comprise a plurality of hydraulic components (e.g., valves, pumps, manifolds, pipes, diverters, etc.) for providing water and/or treating liquids (e.g., detergents, softeners, bleachers, etc.) required for performing laundry-treating procedures.

Generally, an electronic control board, or control unit, is provided in order to manage the operation of the plurality of actionable hydraulic components (e.g., valves, pumps, diverters, etc.).

The generic actionable hydraulic component typically may be actuated electrically, e.g. the actionable hydraulic component is operatively coupled with corresponding input/output ports of the electronic control board in order to receive (electric) power from the electronic control board.

Therefore, a great number of different connections elements, usually one or more wirings for each actionable hydraulic component, has to be provided within the body of the appliance running from the electronic control board to the actionable hydraulic component.

In its turn, the electronic control board has to comprise a corresponding great number of input/output ports in order to being properly connected to each one of the actionable hydraulic component.

Moreover, the electronic control board requires storage and computing capabilities configured for managing each one of the actionable hydraulic components provided in the appliance according to a selected laundry-treating procedure among a set of selectable laundry-treating procedures that the appliance is configured to implement.

In the art some expedients have been proposed in order to mitigate the complexity of the electronic control board and wirings for controlling actionable components provided in the appliance. For example, aggregation of two or more actionable components have been proposed in order to reduce a number of wirings required for actuate such actionable components.

SUMMARY OF INVENTION

The Applicant has observed that, in the known solutions, either a wiring harness required for connecting actionable hydraulic components to an electronic control board of the appliance is bulky and requires an extensive time and skilled technicians during the manufacturing procedure of the appliance or electric interfaces proposed in order to reduce wirings for actuating aggregated actionable components comprise intrinsically weak structures and limited management capabilities with respect to the different actionable components, particularly actionable hydraulic components, comprised in a generic appliance.

In addition, the Applicant has noted that a substantial portion of the workload of the electronic control board is due to generate control signals for efficiently managing the operation of each of actionable hydraulic component comprised in the household appliance.

The Applicant has tackled the problem of devising an improved solution able to overcome, at least partly, the drawbacks of the prior art.

The Applicant has found that providing a concept of water inlet module comprising actionable hydraulic components and capable of managing the operation thereof in a manner substantially independent from an electronic control board that allows greatly simplifying the design, the manufacturing and the maintenance of the appliance are simplified/improved.

One or more aspects of the solution according to embodiments of the invention are set out in the independent claims, with advantageous features of the same solution that are indicated in the dependent claims.

An aspect of the solution according to one or more embodiments of the present invention relates to an appliance. The appliance comprises: a control unit managing the operation of the appliance; at least one hydraulic component actionable for water/treating liquids distribution within the appliance; a plurality of sensors arranged for acquiring information regarding physical parameters associated with the operation of the appliance, and a module managing at least part of the water/treating liquids distribution within the appliance. The module comprises the at least one hydraulic component, at least two sensors of the plurality of sensors, and a local control unit managing the operation of the at least two hydraulic components and/or receiving the information acquired by the at least two sensors.

In an advantageous embodiment of the invention, the at least two sensors of the plurality of sensors are arranged for acquiring water/treating liquids-related information.

In an advantageous embodiment of the invention, the at least one hydraulic component comprises a valve selectively hydraulically coupling a fresh water supply with a water and/or treating liquids storage element of the appliance.

In an advantageous embodiment of the invention, the at least one hydraulic component further comprises a valve selectively hydraulically coupling a hot water supply with a water and/or treating liquids storage element of the appliance.

In an advantageous embodiment of the invention, the appliance further comprises a water softening device selectively reducing a hardness degree of the fresh water. Preferably, the at least one hydraulic component comprises a diverter selectively hydraulically coupling a fresh/hot water supply with the water softening device or to the water/treating liquids storage element.

In an advantageous embodiment of the invention, the appliance further comprises at least one container for storing a treating liquid. Preferably, the at least one hydraulic component further comprises at least a pump for selectively forcing dosed amount of treating liquids stored in the at least one container to a mixing chamber of the appliance.

In an advantageous embodiment of the invention, the at least two sensors comprise a pressure sensor arranged for acquiring an information regarding a pressure exerted by water and/or treating liquids comprised in a water and/or treating liquids storage element of the appliance.

In an advantageous embodiment of the invention, the at least two sensors further comprise at least one among a flow rate sensor arranged for acquiring information regarding an amount of water that passes through a hydraulic component, and a conductivity sensor arranged for acquiring an information regarding a conductivity of the fresh water that passes through a hydraulic component.

In an advantageous embodiment of the invention, the at least one among the flow rate sensor and the conductivity sensor is arranged for acquiring an information regarding water flowing through the at least one hydraulic component.

In an advantageous embodiment of the invention, the appliance further comprises at least an actuator.

In an advantageous embodiment of the invention, the at least one actuator is arranged for actuating the at least one hydraulic component.

In an advantageous embodiment of the invention, the local control unit of the module comprises a memory circuitry storing at least one set of instructions allowing managing the operation of the at least one hydraulic component, and a local control circuitry implementing the at one least a set of instructions allowing managing the operation of the at least one hydraulic component, preferably based on the information provided by at least two sensors.

In an advantageous embodiment of the invention, the local control circuitry manages an operation of the at least one hydraulic component through the at least an actuator.

In an advantageous embodiment of the invention, the appliance further comprises a frame supporting in an operative position, and mechanically coupling together in a single structure, the local control unit, the at least two sensors, and the at least one hydraulic component.

In an advantageous embodiment of the invention, the local control unit of the module is implemented on an electronic board.

In an advantageous embodiment of the invention, the at least two sensors are at least partly implemented on the electronic board.

In an advantageous embodiment of the invention, the frame supports the local control unit and the at least two sensors by supporting the electronic board on which the local control unit and the at least two sensors are provided.

In an advantageous embodiment of the invention, further comprises an enclosing shell at least partly enclosing the electronic board in order to protect the latter from foreign matters and water and/or moisture.

In an advantageous embodiment of the invention, the frame is provided with a structure adapted to act as the enclosing shell.

In an advantageous embodiment of the invention, the module is operatively coupled with at least one external hydraulic component, and/or at least one external sensor. Preferably, the local control unit is configured for managing the operation of the at least one external hydraulic component and/or receiving the information acquired by the least one external sensor.

In an advantageous embodiment of the invention, the at least one external hydraulic component comprises a safety flow-arresting valve arranged for blocking inlet flow of fresh water in case of failure.

In an advantageous embodiment of the invention, the at least one external sensor comprises at least one among a leakages detection arrangement arranged for detecting a leakage of water/treating liquids in the appliance, and a temperature sensor arranged for acquiring a temperature information of water/treating liquids in a water and/or treating liquids storage element of the appliance.

BRIEF DESCRIPTION OF THE ANNEXED DRAWINGS

These and other features and advantages of the present invention will be made apparent by the following description of some exemplary and non-limitative embodiments thereof. For its better intelligibility, the following description should be read making reference to the attached drawings, wherein.

DETAILED DESCRIPTION OF PREFERRED EMBODIMENTS OF THE INVENTION

Figure 1A:
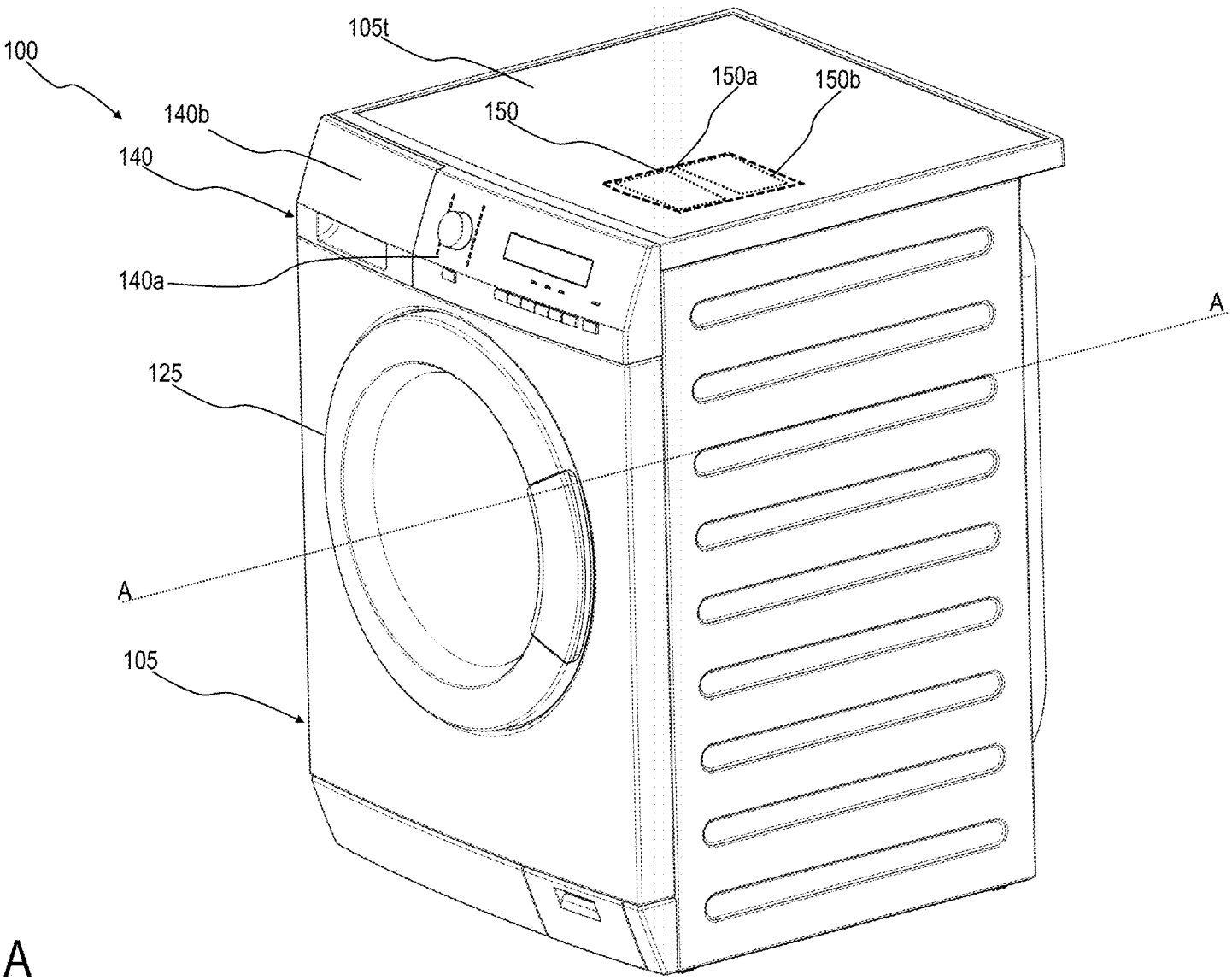
FIG. 1A is a schematic perspective view of a laundry machine in which the present invention can be applied.
Figure 1B:
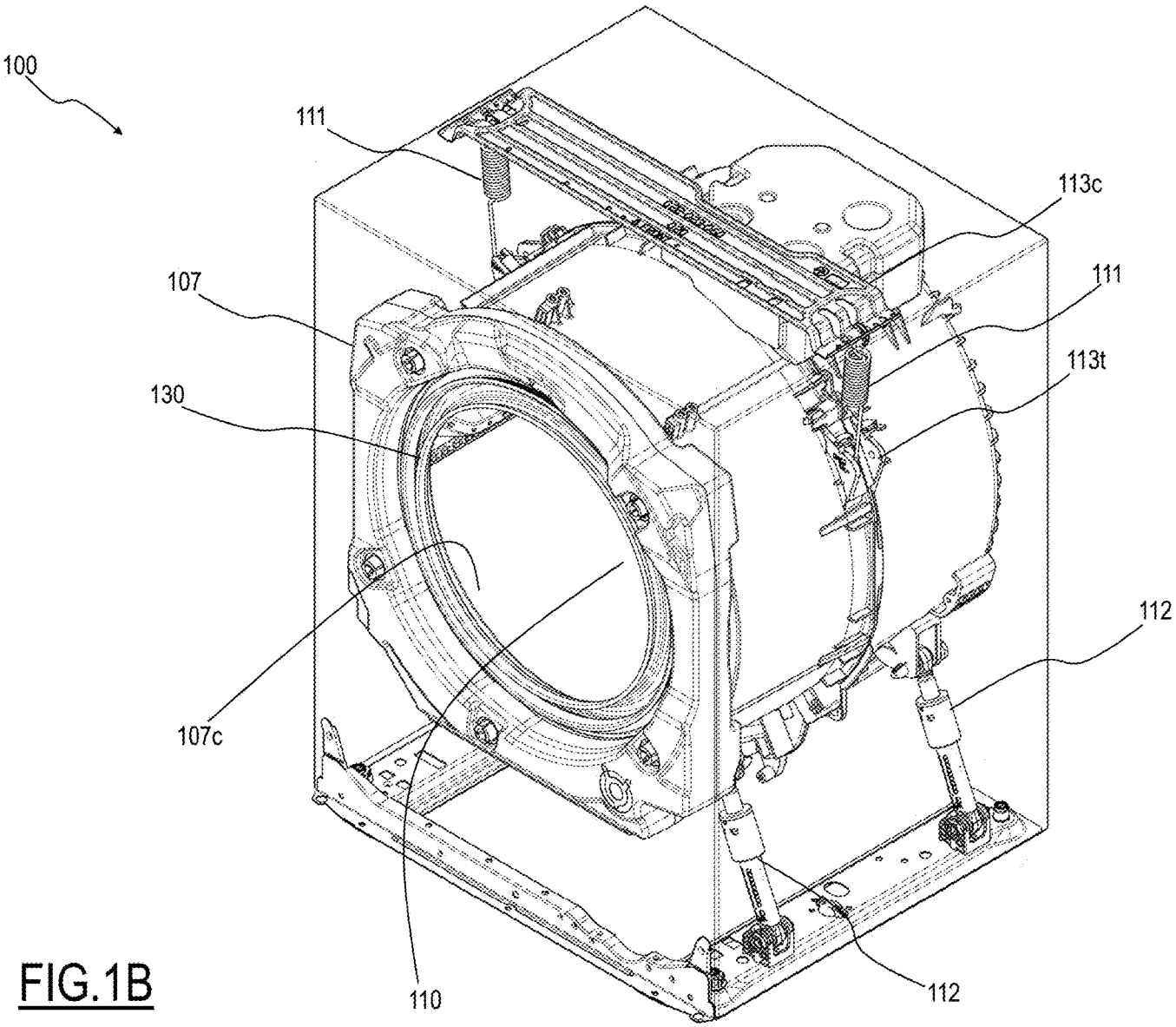
FIG. 1B is a schematic perspective front view of the laundry machine of FIG. 1A with removed parts.
Figure 1C:
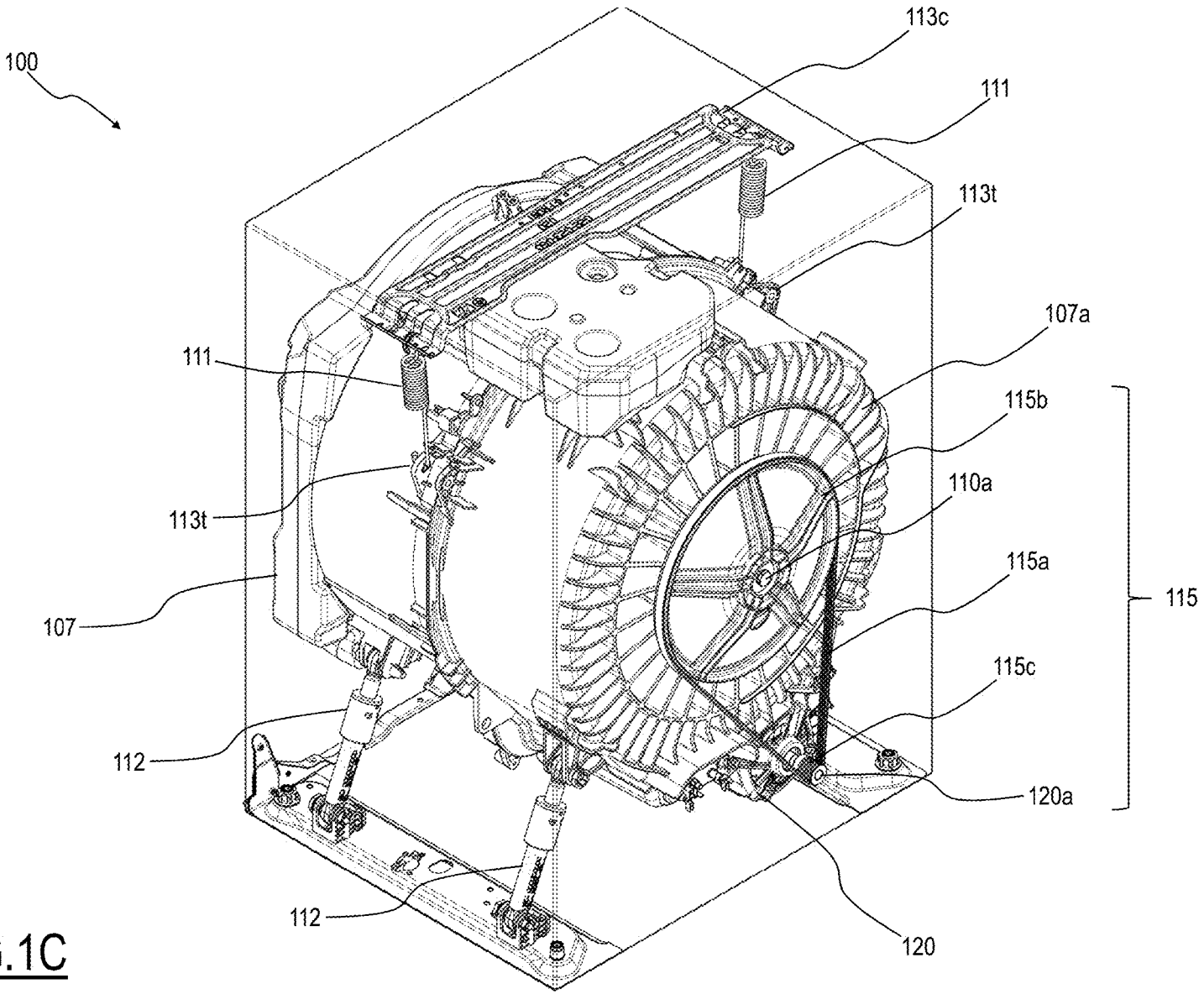
FIG. 1C is a schematic perspective rear view of the laundry machine of FIG. 1A with removed parts.

Referring now to the drawings, FIGS. 1A to 1C, are a schematic perspective view and perspective views with removed parts of a household appliance, particularly a laundry machine 100 in which an embodiment according to the present invention may be applied.

It is stressed that the laundry machine 100 should be considered only as a non-limiting example of a household appliance in which an embodiment of the present invention may be implemented. Indeed, embodiments of the present invention may be applied to any kind of household appliances comprising one or more electrical/electronic/electromechanical components, in the following referred to as e-components for short, designed for performing one or more specific tasks required for the household appliance operation and an electronic control board, or control unit comprising a suitable control circuitry designed for managing whole operation of the household appliance.

The laundry machine 100 is a machine for treating laundry, such as for example a laundry washing machine or a laundry washing/drying machine, of the front-loading type. Anyway, it should be apparent from the following description that laundry machines of the top-loading type may also benefit from the solution according to the present invention.

In the example at issue, the laundry machine 100 comprises a casing or cabinet 105 preferably substantially parallelepiped-shaped, which encloses a washing tub, or simply tub, 107 (as shown in FIGS. 1B and 1C) preferably substantially cylindrically-shaped, wherein the laundry is treated, along with any other component of the laundry machine 100 necessary for its operation (e.g., hydraulic, electronic and electromechanical components).

The tub 107 houses a rotatable drum 110 preferably substantially cylindrically shaped, which, in operation, rotates about an axis A in order to tumble the laundry to be washed.

Typically, the tub 107 is suspended in the casing 105 in such a way to be substantially free to oscillate during its operation. For example, the tub 107 is connected to the casing 105 in a movable manner by means of suspension elements 111 (e.g., spring elements, for example extension springs) and damping elements 112 (e.g., shock absorbers).

In addition, the tub 107 comprises, in a backside or backwall 107*a* thereof, a shaft opening, in which a drum rotor shaft 110*a* is inserted. The rotor shaft 110*a* is attached to the drum 110 and rotatably connected by means of a transmission apparatus 115 to a, preferably electric, drum motor 120 comprised in the laundry machine 100 in order to rotate the drum 110 during operation. The drum motor 120 is preferably, although not limitatively, positioned in a bottom position with respect to the casing 105. The transmission apparatus 115 may comprise a transmission belt or chain 115*a* coupled with a pair of pulleys 115*b* and 115*e*, of which a first pulley 115*b* is mounted to the drum rotor shaft 110*a* while a second pulley 115*e* is mounted to a motor shaft 120*a*.

In the laundry machine 100 the drum motor 120 is preferably mounted to a lower portion of the tub 107, thus the drum motor 120 is integral with the tub 107 and they oscillates together during operation. In this way, also the drum motor 120 and the rotor shaft 110*a* are substantially integral and any oscillation does not affect a tensioning of the chain 115*a* between the pulleys 115*b* and 115*c*.

Alternatively, in other embodiments according to the present invention (not shown in the Figures), the rotating movement may be transferred to the drum in any other known manner; for example, a motor may be directly connected to the drum (so called "direct drive"), with the motor shaft coinciding to the drum shaft.

In order to allow a user to access the tub 107 and the inside of the drum 110 (for loading/unloading the laundry), a loading/unloading opening is advantageously provided on a front side of the laundry machine 100. The loading/unloading opening is closable by a door 125 (as shown in FIG. 1A), which is hinged, preferably, to the casing 105 by means of a hinge (not shown in the figures).

The tub 107 is provided with a tub opening 107*c*, and the drum 110 is provided, with a drum opening. The tub opening 107*e* is aligned with the loading/unloading opening provided in the casing 105, and with the drum opening of the drum 110.

Preferably, in order to achieve a watertight connection between the loading/unloading opening and the tub opening 107*c* (in order to avoid leakages of washing liquid into the casing 105), a bellows 130, preferably made of an elastomeric and waterproof material, is mounted in a watertight manner (such as by gluing, by welding, by interference fitting, etc.) to a border of the loading/unloading opening and is coupled with a border of the tub opening 107*c*.

The tub 107 is fluidly connected to a hydraulic apparatus (not shown in the drawings) adapted to provide treating liquids (e.g., fresh water, and water mixed with detergents) in the washing tub 107 for treating the laundry therein, and to exhaust such liquids once used.

Moreover, a heating element is provided coupled with the tub 107 in order to selectively heat water/treating liquids therein contained.

The laundry machine 100 may possibly comprise also a drying air apparatus (not shown) fluidly connected with the tub 107 adapted to heat up and blow drying air into the tub and draw therefrom moisturized cool air.

In addition, a user interface 140 is advantageously provided, preferably, although not limitatively, on a top portion 105*t* of the casing 105. Preferably, the user interface 140 may comprise a control panel 140*a* for selecting laundry treatment cycles (e.g., a set of operations and parameters designed for treating peculiar fabrics, such as wool items) to be carried out by the laundry machine 100, and a drawer 140*b* for loading laundry-treating products (e.g., detergents, softeners, bleachers, etc.).

The laundry machine 100 is advantageously provided with a (main) control unit 150 (schematically denoted as a dashed rectangle in FIG. 1A), e.g. comprising an electronic board on which at least one (central) control circuitry 150*a* is provided. The control circuitry 150*a* comprises one or more microprocessors/microcontrollers, an application-specific integrated circuit—ASIC—or a similar electronic control component and, possibly, further processing circuitry (such as a Digital Signal Processor—DSP—, etc.) adapted to control the laundry machine 100 operation, which is preferably, although not necessarily, placed in a top position inside the casing in order to be less prone to contacts with liquids or humidity possibly leaking from the tub 107.

In an embodiment of the invention, the control unit 150 is further arranged for supplying power (e.g., at one or more DC and/or AC voltage values) and interacting with the e-components comprised in the laundry machine 100—such as for example the drum motor 120, (actionable) hydraulic components (e.g., electromechanical valves, pumps and impellers) of the hydraulic apparatus, one or more heating elements for heating water/treating liquids/air, the user interface 140*a*, etc.—in order to manage an execution of selected laundry-treating operations featured by the laundry machine 100.

To this extent, the control unit 150 comprises a power supply circuitry 150*b*, preferably along with control circuitry 150*a* mentioned above. The power supply circuitry 150*b* of the control unit 150 is preferably arranged for receiving the AC mains to which the control unit 150 is connected—e.g. by means of a power cord (such connection is omitted in the figures for the sake of simplicity and since well-known in the art)—and converts the AC voltage received in one or more DC voltages adapted to power electronic components (e.g., such as a 5 VDC).

In addition, the power supply circuitry 150*b* of the control unit 150 may be also designed for providing a power supply at high voltage—e.g., a voltage ranging from 100V to 275 V, such as for example 110V or 220V, preferably but not limitatively an AC high voltage.

The power supply at high voltage is provided to e-components which requires high voltages for their operation (e.g., heaters and the drum motor 120).

In alternative embodiment of the present invention (not shown), a stand-alone power unit may be provided instead of having the power supply circuitry 150*b* integrated in the control unit 150.

Advantageously, the laundry machine 100 is further provided with one or more load sensing devices, i.e. sensors, arranged for acquiring information regarding physical parameters associated with the operation of the laundry machine 100 (e.g., the sensors provide indications of values of physical parameters associated with the laundry machine 100 operation), preferably in the form of electric signals, which are exploited for an accurate and effective provision of the laundry-treating operations.

For example, the laundry machine 100 may comprise one or more temperature sensors for monitoring a water and/or air temperature inside the tub 107, weight sensors for estimating a weight of laundry items loaded in the drum 110, humidity sensor estimating a humidity of laundry items loaded in the drum 110, oscillation and/or vibration sensors for estimating an extent of displacements of the tub 107 during operation, flowmeters for assessing an amount of water and/or treating products in liquid form introduced in the tub 107, etc.

Figure 2A:
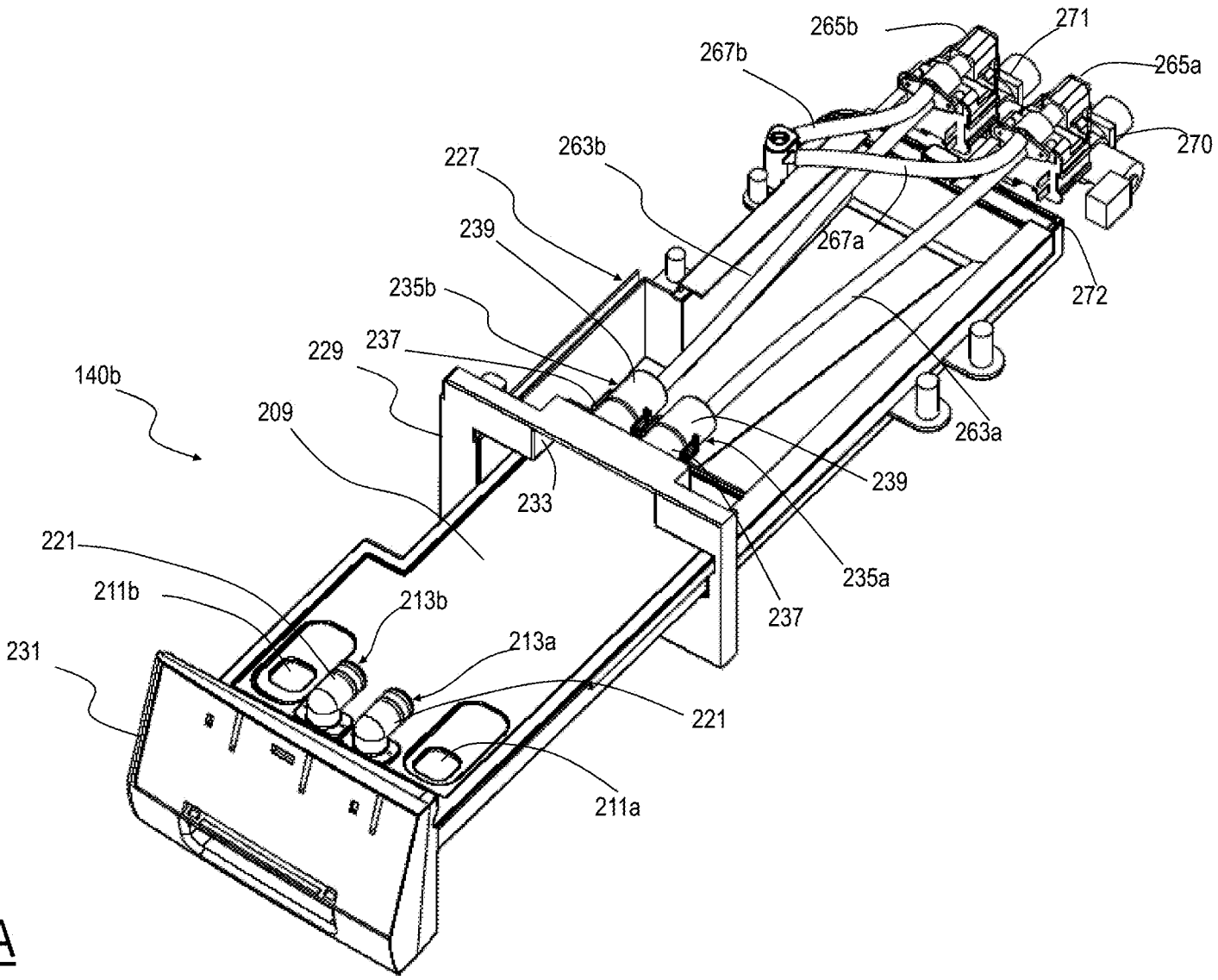
FIG. 2A is a perspective view of the drawer of the laundry machine of FIGS. 1A-C in a partially pulled-out, open condition (partially extracted from its seat)
Figure 2B:
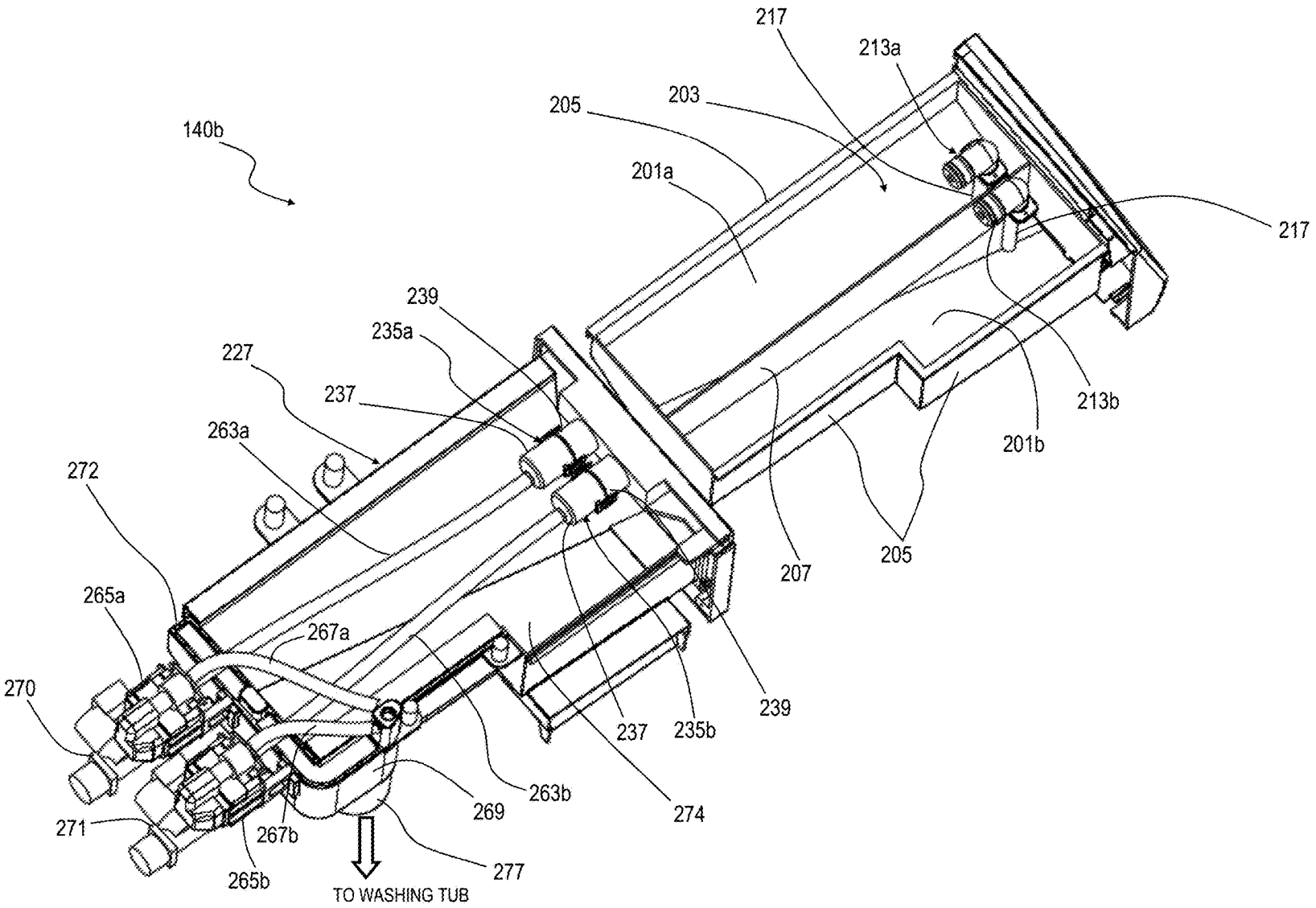
FIG. 2B is a perspective view of the drawer of the laundry machine of FIGS. 1A-C fully extracted from the seat and with removed parts.

FIGS. 2A and 2B are perspective views of the drawer 140*b* in a partially pulled-out, open condition (partially extracted from its seat), and the drawer 140*b* fully extracted from the seat (from a different angle of view and without a component), respectively.

The drawer 140*b* is shaped so as to define one or more containers, such as for example two containers 201*a* and 201*b* in the example of FIG. 2B, for respective (two) different laundry washing treatments products in liquid form, or treating liquids in brief.

For example, the container 201*a*, of higher capacity, is for the washing detergent, and the container 201*b* is for the softener.

The two containers 201*a* and 201*b* are defined by a drawer bottom wall 203 and by drawer lateral, perimetral walls 205, and are separated by an intermediate wall 207 rising from the bottom wall 203 of the drawer 140*b* and extending the whole length thereof.

Preferably, the drawer bottom wall 203 is inclined towards the drawer front, so that the height of the two containers 201*a* and 201*b* decreases going from the drawer front towards the rear thereof.

Generally, the two containers 201*a* and 201*b* are open at the top. Preferably, a cap 209 is provided for closing the two containers. Even more preferably the cap is removable (by removing the cap 20, the user may gain access to the containers for, e.g., cleaning purposes).

In the cap 209, load apertures 211*a* and 211*b* are provided, one over each of the containers 201*a* and 201*b*, for pouring the proper treatment product into the containers 201*a* and 201*b*.

Associated to the cap 209 are two suction pipes 213*a* and 213*b*, one in correspondence of the detergent container 201*a* and the other in correspondence of the softener container 201*b*.

Preferably, the suction pipes 213*a* and 213*b* comprise each a vertical pipe portion 217 (visible in FIG. 2B) penetrating into the respective container substantially down to the bottom thereof (so that, when the container 201*a* or 201*b* is filled with the proper treatment product, an aperture at the bottom of the vertical pipe portion is located well below the level of the treatment product surface), and an elbow portion 221 positioned over the cap 209.

A drawer seat, overall denoted 227, is shaped so as to slidably accommodate the drawer 140*b*, and guide the drawer 140*b* in the extraction/insertion movements.

Preferably, the drawer seat 227 comprises a front frame 229 for the abutment of a drawer front panel 231. The front frame 229 has a recess 233 formed in a top side thereof, the recess 233 being adapted to allow the passage of the elbow portions of the two suction pipes 213*a* and 213*b* when the drawer 140*b* is fully pushed into the casing 105 (a preferable/optional condition in which the drawer front panel 231 results essentially flush with the control panel 120).

In an embodiment of the invention, two valves are formed in the drawer seat 227. Each of the two valves comprises a hollow valve body 235*a*, 235*b* protruding from the front frame 229 towards the rear of the casing 105; the two valve bodies 235*a* and 235*b*, which in the shown exemplary embodiment are preferably formed in one piece with the front frame 229, are positioned so as to result aligned to the elbow portions 221 of the two suction pipes 213*a* and 213*b*.

Both the two valve bodies 235*a* and 235*b* have a first portion of shape and size adapted to tightly receive therein the free end portion of the elbow portions 221 of the suction pipes 213*a* and 213*b*.

Advantageously, sealing elements, such as for example one or more O-rings, are provided on a free end portion of the elbow portions 221, thus ensuring a tight seal when said free end portions 223 of the elbow portions 221 are inserted into the first portion 237 of the valve bodies 235*a* and 235*b*.

In, an embodiment of the invention, the valve bodies 235*a* and 235*b* have a second portion 239 following the first portion 237, which accommodates a valve member (not shown) forming a fluid passage cut-off element.

The valve bodies 235*a* and 235*b* are operatively connected to respective flexible pipes 263*a*, 263*b*, each of which leading to the intake of a respective suction pump 265*a*, 265*b*.

According to an embodiment of the present invention, the two pumps 26*a* and 265*b* of the non-limiting example of FIGS. 2A and 2B are positive displacement pumps, for example volumetric pumps, reciprocating pumps, gear pumps, peristaltic pump, and any other type of pump adapted to displace dosed amounts of treating liquids.

It should be noted that the number of suction pumps might vary in different embodiments according to the number of compartments provided in the drawer of the laundry machine.

The two pumps 265*a* and 265*b* have each a delivery outlet which is fluidly connected, by means of a respective flexible pipe 267*a* and 267*b*, to respective inlets of a mixing chamber 269, located at a rear corner (in particular, but not limitatively, the rear left corner as seen from the front) of the seat 227 for the drawer 140*b*. Preferably, the mixing chamber 269 is in a single-piece construction with the drawer seat 227; even more preferably, the mixing chamber 269 is obtained by a plastic injection-moulding process.

One or more electrovalves (e.g., solenoid valves), such as two electrovalves 270 and 271, are provided (as described in the following). Preferably the electrovalves 270 and 271 are fluidly connected, through respective conduits, to a water load chamber 272, located behind the drawer seat 227 and for example in one piece therewith. The water load chamber 272 is shaped so as to define a channel that turns around the rear left corner of the drawer seat 227 and opens into the mixing chamber 269. The two electrovalves 270 and 271 are respectively connectable, by means of hoses, to a cold water and a hot water delivery ports intended to be present. in the premises of the user where the appliance is to be located (in alternative embodiments of the invention, only one electrovalve may be present, for the connection to the cold water or hot water delivery port). The two electrovalves 270 and 271 are for example attached to the rear of the water load chamber by means of brackets, The water load chamber 272 forms an air gap (air break) between the outlets of the electrovalves and the mixing chamber 269.

The mixing chamber 269 opens at the bottom into a manifold 277 which is in fluid communication with the washing tub (for example, to this purpose a flexible hose, a bellows—not shown in the drawings—may be used), for delivering thereto the washing water, possibly mixed with the laundry treatment products, and the rinsing water.

Level sensors (not shown in the drawings) for sensing the level of laundry treatment products may be provided within, or be operatively associated with the two containers 201*a* and 201*b*. The level sensors, which may for example be one or more capacitive sensors, optical sensors, conductivity sensors, and may be mounted on the drawers, or on the drawer seat, for example along the side walls thereof, are used to provide the user with indications (for example, through visual indicators provided on the control panel 120) about the necessity of refilling the containers 201*a* and 201*b*.

Preferably, an air space (not visible in the figures) is formed at the bottom of the drawer seat 227. For example, the air space is defined by the bottom walls of the drawer seat 227 and a (possibly removable, or formed in one piece with the drawer seat) panel 274 that separates the air space at the bottom of the drawer seat 227 from an upper area of the drawer seat 227 intended to accommodate the drawer 140*b*.

Advantageously, the air space is in air communication with the washing tub, for example through the flexible hose or bellow that connects the manifold 277 to the washing tub). The user may extract the drawer 140*b* from its seat 227 and pour the desired laundry treatment products, e.g. detergent and/or softener (depending on the washing cycle he/she wishes the machine to perform) into the proper containers 201*a* and/or 201*b* formed in the drawer 140*b*. When the drawer 140*b* is pulled out, as in FIGS. 2A and 2B, the elbow portions 221 of the suction pipes 213*a* and 213*b* are extracted from the respective valve bodies 235*a* and 235*b*. Preferably, the valve bodies 235*a* and 235*b* comprise a unidirectional blocking arrangement (not visible in the figures) that is provided for allowing the insertion and watertight fluid connection of the respective the elbow portions 221 of the suction pipes 213*a* and 213*b* and, at the same time, is provided for closing (preferably sealing) the respective valve bodies 235*a* and 235*b* preventing any leakage of treating liquids from the containers 201*a* and/or 201*b* through the flexible pipes 263*a*, 263*b* when the drawer 140*b* is removed from its seat 227 (and the elbow portions 221 of the suction pipes 213*a* and 213*b* are removed from the valve bodies 235*a* and 235*b*).

When either the pump 265*a* or the pump 265*b* is activated (according to the timing of the washing program), it sucks a dosed amount of the respective treating liquid, detergent and/or softener, from the container 201*a* or 201*b* formed in the drawer 140*b*; the treatment liquid is then delivered to the mixing chamber 269, where it may be mixed with cold and/or hot water taken in from the water mains, and the mix thus obtained is then delivered to the washing tub 107. In other words, the pumps 265*a* and 265*b* are arranged for forcing a (predetermined amount of) treating liquid out of the containers 201*a* and 201*b*, respectively, into the mixing chamber 269.

The two containers 201*a* and 201*b* provide a bulk storage of laundry treatment products within the appliance; the capacity of the containers 201*a* and 201*b* may be higher than the amount of laundry treatment product necessary for one washing cycle, and may suffice for several washing cycles, so that the user no longer needs to pour into the appliance the laundry treatment products before starting every washing cycle. An auto-dosing of the treatment products is achieved thanks to the provision of the, pumps 265*a* and 265*b*, which take from the containers 201*a* and 201*b* the precise amount of treatment product needed for the single washing cycle; this translates into a saving of laundry treatment products, with a beneficial impact also on the environment.

The proper doses of treatment products are taken from the containers 201*a* and 201*b* in the drawer 140*b* by the suction action of the pumps 265*a* and 265*b*, i.e. the treatment products do not fall by gravity from the containers. The suction is from above the level of the surface of the treatment products stored in the containers, i.e. the dose of treatment product to be delivered to the washing tub is raised above the surface level. This allows avoiding any possible leakage of treatment products.

The water load chamber 272 provides a separation between the outlets of the electrovalves 270 and 271 and the mixing chamber 269 Where the pipes 267*a* and 267*b* from the pumps 265*a* and 265*b* open. In this way, it is ensured that no treating liquid leaks into the electrovalves 270 and 271 and returns to the cold/hot water mains.

Once the drawer 140*b* is in its working position, the drawer 140*b* is in fluid communication with the washing tub 107 only through the pumps. Thus, vapours that originate in the tub 107 during the laundry washing cannot be discharged through the drawer 140*b*.

Conversely, the air space in fluid communication with the washing tub 107 defines a vapours discharge path that allows discharging vapours coming from the washing tub 107 during the washing cycles. Preferably, the vapours are discharged into the casing 105.

The discharge of the vapours also prevents that the laundry treatment products stored in the containers 201*a* and 201*b* of the drawer 140*b* are heated up by the vapours, which is believed to be undesirable, since repeatedly heating up the laundry treatment products might alter their properties.

An advantage of this solution resides in that when the drawer 140*b* is pulled out of the seat 227 for, e.g., the replenishment of the treatment products containers 201*a* and 201*b*, any possible leakage of treatment products from the valve bodies 235*a* and 235*b* (i.e., residues of treatment product in the valve bodies) drops onto the cap 209, from where it can be easily removed by the user.

Preferably, the drawer seat 227, the mixing chamber 269, the water load chamber 272, and/or the manifold 277 may be formed as a single-piece component, obtained by a plastic injection-moulding process; this reduction of separated parts simplifies assembling operations.

Further details on the drawer 140*b*, drawer seat 227, the mixing chamber 269, the water load chamber 272, and related hydraulic components just described may be found in EP 2251481 from the same Applicant, which is hereby incorporated by reference.

It should be noted that the drawer 140*b* described above with respect to FIGS. 2A and 2B is a non-limiting example of a drawer of laundry machine in which water inlet module according to an embodiment of the present invention (as described in the following) may be provided.

Indeed, other drawer and drawer seat structures and arrangements may be provided in the laundry machine without departing from the scope of the invention.

For example, an alternative drawer (known, and not shown in the drawings for the sake of conciseness) may comprise one or more compartments each of which is, preferably, arranged for receiving a respective treating products (e.g., a detergent compartment for detergent, a softener compartment for softener, etc.).

The alternative drawer does not comprise the auto-dosing arrangement described above, i.e. the suction pipes 213*a* and 213*b*, valve bodies 235*a* and 235*b*, the pumps 265*a* and 265*b*, and the flexible pipes 267*a* and 267*b*. Instead, a user provides a desired amount of treating products in the corresponding compartment of the alternative drawer.

During operation, water is selectively fed by a flushing device (e.g., managed by the water inlet module described in the following) in the one or more compartments in order to mix and/or dilutes the respective treating product stored therein, i.e. forming a corresponding treating liquid. Moreover, each treating liquid is flushed from the respective compartment of the alternative drawer into the tub of the laundry machine through one or more outlet ports provided in the drawer.

Optionally, an outflow valve, such as for example an electrovalve (e.g., managed by the water inlet module described in the following), may be provided in order to control the outflow of the treating liquids from the alternative drawer.

Figure 3:
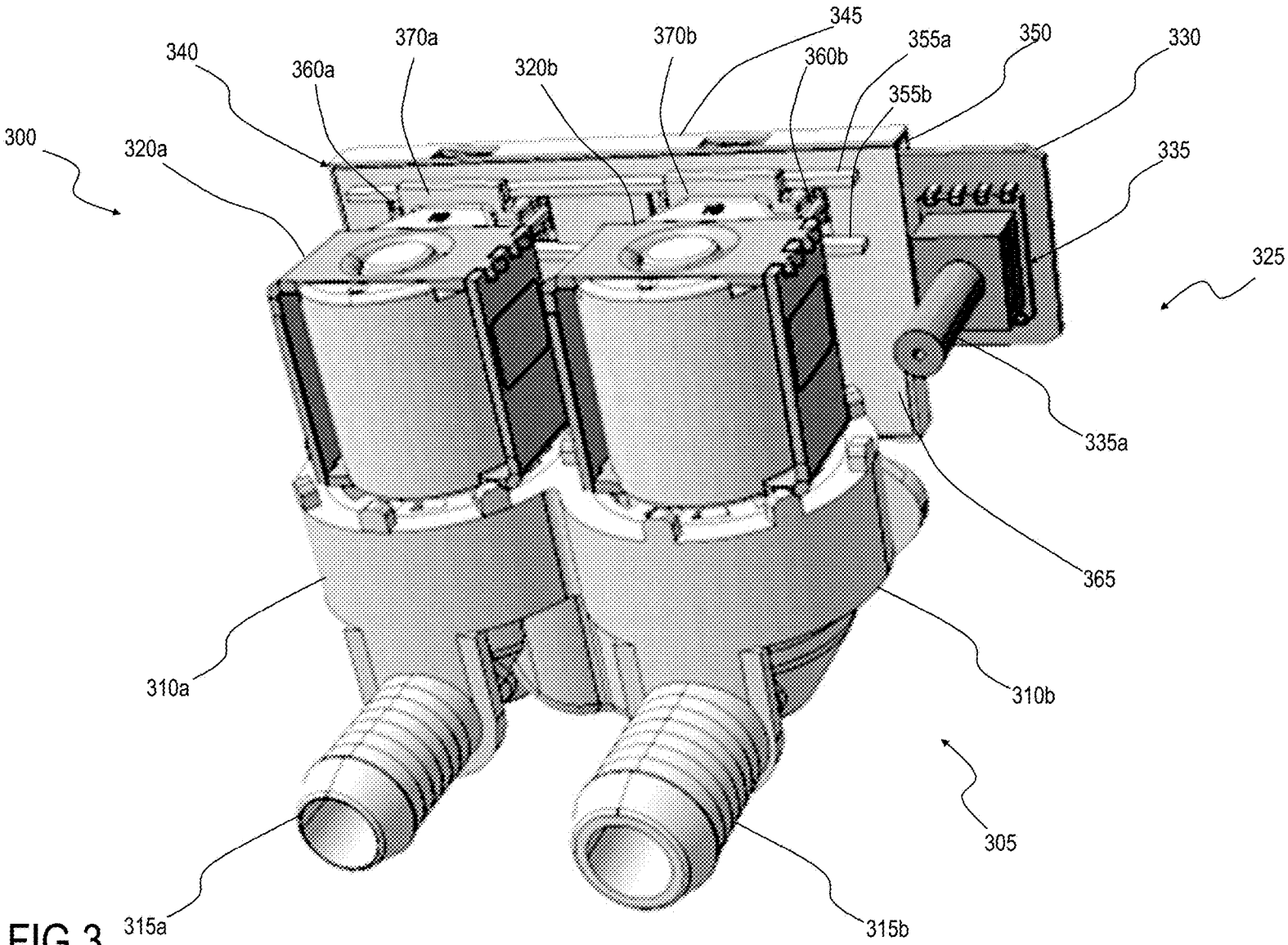
FIG. 3 is an exemplary water inlet module according to a non-limiting embodiment of the present invention.

With reference to FIG. 3, is now described an exemplary water inlet module 300 according to a non-limiting embodiment of the present invention adapted for the use in the laundry machine 100.

The water inlet module 300 comprises a hydraulic portion 305, which in its turn comprises a couple of valves 310*a* and 310*b* (e.g., electrovalves such as solenoid valves). The valves 310*a* and 310*b* are fluidly connected to respective water inlet ports (e.g., one receiving cold water and the other receiving hot water, not visible in FIG. 3), and to respective outlet ports 315*a* and 315*b*. The valves 310*a* and 310*b* are arranged for selectively allowing water flowing from the respective inlet port to the respective outlet port 315*a* and 315*b*.

For example, the valves 310*a* and 310*b* may correspond to the electrovalves 270 and 271 previously described with reference to FIGS. 2A and 28, and the outlet ports 315*a* and 315*b* are fluidly connected, through respective conduits, to the water load chamber 272 (also previously described with reference to FIGS. 2A and 2B).

As a further example, the valves 310*a* and 310*b* may be connected, or may be part of, the flushing device comprised in the alternative drawer described above.

The actuation (i.e., the opening and closing) of the valves 310*a* and 310*b* is performed by two actuators 320*a* and 320*b*, respectively, being part of an I/O interface of an electronic portion 325 of the water inlet module 300. For example, the valves 310*a* and 310*b* are solenoid valves and the actuators 320*a* and 320*b* are configured for generating an electromagnetic field adapted to switch the valves from an opened condition to a closed condition and vice versa. To this extent, each one of the actuators 320*a* and 320*b* is operatively coupled with the respective valve 310*a* or 310*b*.

The electronic portion 325 further comprises an electronic board 330 on which a local control unit (not visible in FIG. 3) is provided for controlling the operation of the water inlet module 300. Preferably, the local control unit comprises a control circuitry featuring one or more among microprocessors, microcontrollers, an application-specific integrated circuit—ASIC—or a similar electronic control component and, possibly, further processing circuitry such as a Digital Signal Processor—DSP—, etc. Moreover, the local control unit comprises a memory circuitry preferably featuring one or more volatile and/or non-volatile memory elements, such as for example RAM modules, EEPROMs, Solid State Drives, look-up tables, etc.

The electronic portion 325 further comprises one or more I/O interfaces arranged for exchanging (i.e., receiving and/or transmitting) electric signal with other components of the laundry machine 100, such as for example the control unit 150.

The electronic portion 325 further comprises one or more sensors, such as a pressure sensor 335.

The actuators 320*a* and 320*b* are electrically coupled with the electronic board 330 in order to be controlled by the local control unit.

In addition, the water inlet module 300 comprises a frame 340 which is arranged for supporting the electronic portion 325 and the hydraulic portion 305 in an operative position and, at the same time, maintain the electronic portion 325 and the hydraulic portion 305 mechanically coupled together in a single structure.

Preferably, although not limitatively, the frame 340 is made of a suitable material, such as for example a metal (e.g., stainless steel, aluminum, etc.), possibly coated with an insulating and/or protective coating (e.g., an enamel). Advantageously, such metallic frame 340 may be made from a single metal sheet conveniently punched and/or plied.

Alternatively, the frame 340 may be made of a suitable polymer, and possibly formed by injection moulding.

According to the non-limiting example of FIG. 3, the frame 340 has a substantially parallelepiped-shaped hollow body 345, which is arranged for receiving at least a portion of the electronic board 330 that may be inserted in the hollow body 345 through a side opening 350 provided for this purpose, preferably, on a lateral wall of the frame 340.

It should be noted that the frame 340 according to the embodiment of the invention just described, in addition to supporting the electronic portion 305, also acts as an enclosing shell for at least a part of the electronic portion 305

Preferably, the frame 340 comprises a coupling arrangement 355 for mechanical coupling with the actuators 320*a* and 320*b* in order to maintain them in position and allowing the electric coupling with the electronic board 330.

In an embodiment of the invention, the operative coupling between the actuators 320*a* and 320*b*, the electronic board 330 is provided by respective electric connections passing through corresponding windows 360*a* and 360*b* provided for this purpose, preferably, on a main surface 365 of the frame structure 340.

In the non-limiting example of FIG. 3, the coupling arrangement 355 comprises a couple of rails 355*a* and 355*b* provided on the main surface 365 extending parallel one to the other and separated by a predetermined distance d.

Advantageously, the windows 360*a* and 360*b* are cut out on a portion of the main surface 365 comprised between such rails 355*a* and 355*b*.

Accordingly, each one of the actuators 320*a* and 320*b* comprises a respective mounting plate 370*a* and 370*b* arranged to mechanically coupling with the rails 355*a* and 355*b* either directly (e.g., by means of attaching portions adapted to snap-fit with the rails 455*a* and 455*b*) or by employing additional fasteners (e.g. clamp elements clamping together the mounting plates 370*a* and 370*b* and the rails 355*a* and 355*b*).

Advantageously, each one of the mounting plates 370*a* and 370*b* comprises an opening (not visible in FIG. 3) arranged for performing the electric connections between the actuators 320*a* and 320*b* and the electronic board 330.

In this way, the hydraulic portion 305 and the electronic portion 325 are both mechanically and electrically coupled together, and the water inlet module 300 may be generally considered, managed and mounted to the laundry machine 100, as a substantially monolithic element.

Preferably, even though non-limitatively, a portion of the electronic board 330 bearing the pressure sensor 335 protrudes from the side opening 350 of the frame 340. Such an arrangement of the water inlet module 300 allows (fluidically) connecting the pressure sensor with the washing tub 107, or alternatively, another water/treating liquid storage element of the laundry machine 100 (such as for example the water load chamber 272) through a pipe (not shown in FIG. 3), which is sized in such a way to receive a protruding probing portion 335*a* of the pressure sensor 335 at a first opened end.

In a non-limiting embodiment of the present invention, the water inlet module 300 may further comprise a flow rate sensor, or flowmeter (not visible in FIG. 3) for measuring the flow rate and/or the amount of water that passes through at least one of the valves 310*a* and 310*b*.

Preferably, a respective flowmeter, is provided within both the valves 310*a* and 310*b*. For example, each one of the flowmeters comprise an impeller provided within valves 310*a* and 310*b* that is rotated by water flowing through the corresponding valve 310*a* or 310*b*, when the latter is in the open condition. The impeller preferably comprises a (preferably intrinsic) magnet element that, during the rotation of the impeller, generates a variable magnetic field. The magnetic field (and/or preferably its changes in time) is detected by a magnetic field detector, part of the flowmeter (and preferably also provided in the valves 310*a* and 310*b*), which is electrically connected with the electronic board 330 in order to provide indication of flowrate, and/or indication of water amounts flowed, through the corresponding valve 310*a* or 310*b* to the local control unit. Advantageously, connection elements (e.g., wirings) electrically connecting the flowmeter with the electronic board 330 may be contained in an enclosure of the actuators 320*a* and 320*b* and pass through the opening in the mounting plates 370*a* and 370*b*, and the windows 360*a* and 360*b* of the frame 340.

During operation, the local control unit provided on the electronic board 330 manages the opening and closing of the valves 310*a* and 310*b* of the water inlet module 300 in order to provide a desired amount of water/liquid to the water load chamber 272 and/or the washing tub 107 required for performing a selected laundry-treating procedure.

Advantageously, the amount of water/liquid provided in the tub 107 is evaluated based on the information provided by the pressure sensor 335.

Indeed, the water comprised in the washing tub 107 compresses air in the pipe that fluidically connects the pressure sensor 335 with the washing tub 107 and the pressure sensor 335 detects a pressure in the pipe and changes thereof. In other words, the pressure sensor is arranged to measure the pressure, and pressure changes, exerted by a 'water column' (of water and/or washing liquid within the washing tub 107) towering above an open end of the pipe connected at a bottom portion of the washing tub 107.

Therefore, the pressure measurement performed by the pressure sensor 335 may be exploited by the local control circuitry (provided on the electronic board 330) in order to evaluate an amount of water/washing liquid comprised in the washing tub 107.

Accordingly, the local control circuitry operates the actuators 320*a* and 320*b* in order to open or close the valves 310*a* and 310*b* to feed a desired quantity of water to the water load chamber 272 and, therefrom, to the washing tub 107 based on the selected laundry-treating procedure.

Advantageously, the pressure information provided by the pressure sensor 335 may be combined with flowrate information provided by the flowmeter whether provided in the water inlet module in order to obtain more accurate measurements of the amount of water/treating liquids introduced in the washing tub 107.

The water inlet module 300 is designed to operate in a manner substantially independent from the control unit 150 that generally manages the overall operation of the laundry machine 100.

Preferably, the local control unit autonomously manages as described in the following) the operation of the valves 310*a* and 310*b* based on an indication of a laundry-treating procedure to be implemented (initially) provided by the control circuitry 150*a* of the control unit 150 through an electric, preferably digital, signal transmitted over an I/O interface (not shown in FIG. 3) electrically connecting the control unit 150 of the laundry machine 100 and the local control unit of the water inlet module 300.

It should be noted that a multiplicity of different embodiments may be implemented without departing from the scope of the present invention.

Moreover, the present invention is not limited to the structure and disposition oldie drawer 140*b* described above.

In embodiments of the invention, the two suction pumps 265*a* and 265*b* described above, may be comprised in the water inlet module together with the one or more valves, such as the valves 310*a* and 310*b* described above.

In this case, the pumps are mechanically connected to a frame, such as the frame 340 described above, and electrically connected to a local control unit, such as for example the local control unit arranged on the electronic board 330 described above.

Therefore, the pumps 265*a* and 265*b* can be hydraulic components of the water inlet module and substantially integral with the valves and the electronic portion of the water inlet module (being all such components mounted to the frame of the water inlet module).

Accordingly, the operation of the two suction pumps 265*a* and 265*b* is managed by the local control unit provided on the control board (such as the control board 330 described above) of the water inlet module. In other words, the local control unit determines the dosed amount of the respective treatment product, detergent and/or softener, from the container 201*a* or 201*b* to be delivered to the mixing chamber 269, e.g. based on the set of instruction stored in the memory circuitry of the local control unit.

In alternative or in addition, fluid level sensors may be provided in the containers 201*a* and 201*b* and electrically coupled with the local control unit provided on the control board of the water inlet module 300 in order to estimating an amount of treatment product comprised in the containers 201*a* and 201*b* and/or whether the containers 201*a* and 201*b* are empty.

Preferably, in case the containers 201*a* and 201*b* are empty the local control circuitry may detect the necessity to refill them and, accordingly, may generate a corresponding (electric) signal which is issued (e.g., through a corresponding I/O interface) to the main control unit 150 or to the user interface 140.

It should be apparent that a variety of changes and modifications may be implemented in water inlet modules according to the present invention, in order to comply with specific requirements of the laundry machine in which each water inlet module is implemented.

In an embodiment of the invention, the water inlet module may comprise one or more valves, or diverters, each possibly comprising a number of inlet and/or outlet ports different than one (1).

For example, the water inlet module (not shown) may comprise a valve connected to an inlet port (e.g., from which fresh water from the mains is fed) and two or more outlet ports. Preferably, each one of the outlet ports is provided for delivering fresh water to a different portion of the laundry machine (e.g., different agent compartments of the drawer may be directly fed with water through a respective outlet port).

Generally, noting prevents to implement a water inlet module (not shown) comprising two or more inlet ports (e.g., a first port receiving fresh water, a second port receiving hot water, and a third port receiving purified and/or descaled water, a fourth port may receive gray water, etc.) which can be selectively connected with one or more outlet ports (each one hydraulically connected to a respective portion of the laundry machine in order to deliver water/liquid thereto) by opening the valve interposed between the two or more inlet ports and the one or more outlet ports.

As should be noticed by the skilled person, water inlet modules according to the present invention are characterized by a high modularity. In other words, hydraulic components and sensors may be added to the water inlet module according to the present invention with minimum changes to the structure thereof.

Figure 4:
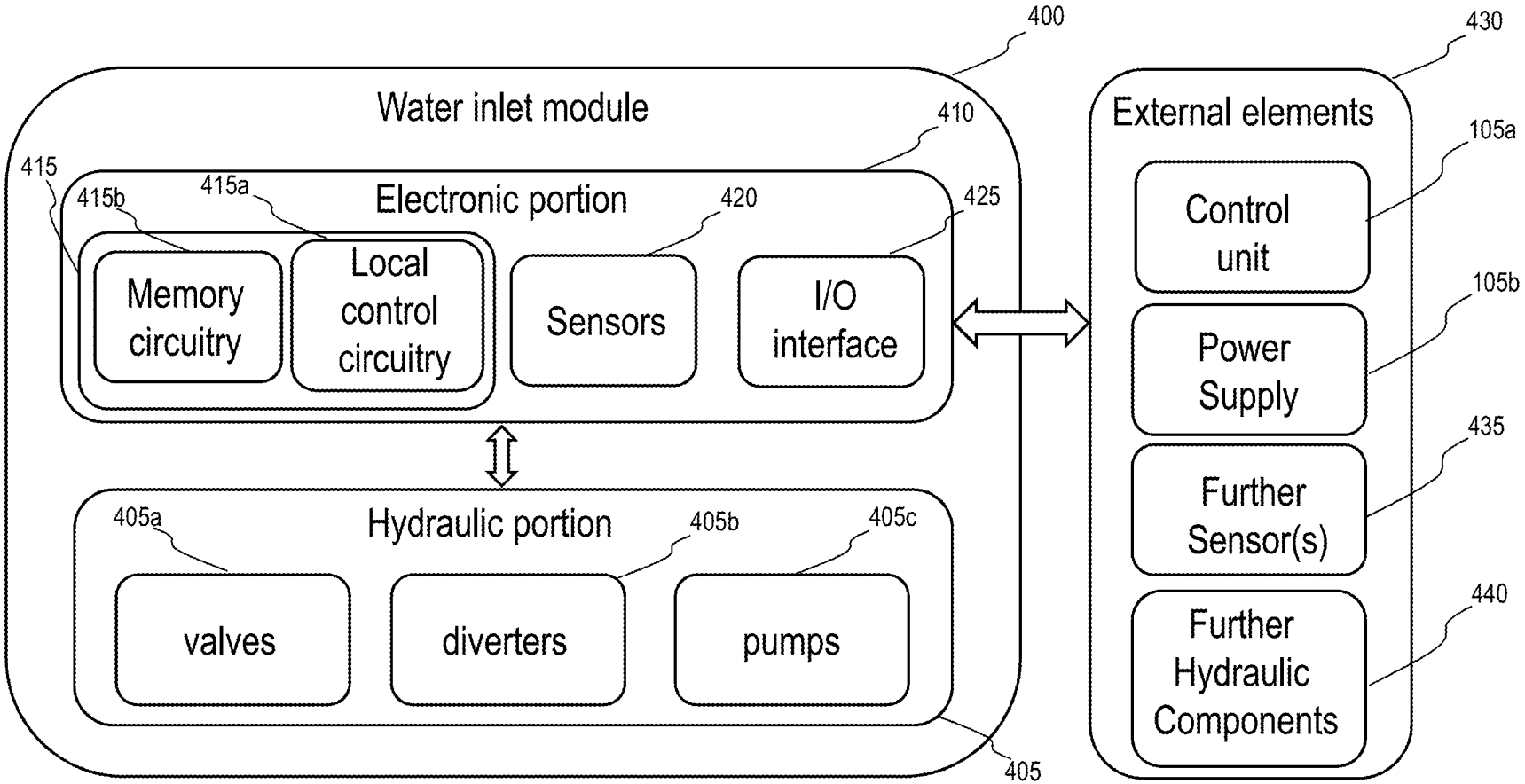
FIG. 4 is a schematic diagram of a generic water inlet module according to an embodiment of the present invention.

Therefore, the structure of a generic water inlet module 409 according to an embodiment of the present invention is now described by making reference to FIG. 4, which is a schematic diagram thereof.

The water inlet module 400 is preferably, although not limitatively, arranged for comprising and managing hydraulic components that are exploited for controlling the introduction of water within the laundry machine 100 and/or, possibly, the management of treating liquids distribution within the laundry machine 100 during operation.

In an embodiment of the invention, the water inlet module 400 comprises a hydraulic portion 405 and an electronic portion 410.

The hydraulic portion 405 of the water inlet module 400 comprises one or more hydraulic components, such as for example one or more (electrically controlled) valves 405*a* (e.g., the electrovalves 270 and 271 or valves 310*a* and 310*b* described above); each of which may either have a single inlet and outlet, or multiple inlets and/or outlets.

In addition or as an alternative, the hydraulic portion 495 may comprise one or more hydraulic diverters 405*b* (known in the art and herein not described for the sake of brevity) for controlling the flow of water into the laundry machine 100.

Preferably, the water inlet module 400 is arranged for comprising and managing also hydraulic components, such as for example pumps 405*c* (e.g., the pumps 265*a* and 265*b* as noted above), exploited for dosing of water and/or treating liquids (e.g., detergents, softeners, bleachers, etc.) and the mixing of treating liquids with water.

According to an embodiment of the invention, the electronic portion 410 of the water inlet module 400 comprises a local control unit 415 arranged for managing the operation of the hydraulic components 405*a-c* of the hydraulic portion 405.

Preferably, the local control unit 415 comprises a local control circuitry 415*a* and a memory circuitry 415*b* configured for implementing and storing, respectively, one or more set of instructions allowing managing the operation of each one of the hydraulic components 405*a-c*.

Even more preferably, the control circuitry 415*a* may comprise one or more microprocessors, microcontrollers, Application-Specific Integrated Circuits—ASICs—or a similar electronic control components and, possibly, further processing circuitry such as a Digital Signal Processor—DSP—, etc. Similarly, the memory circuitry 415*b* may comprise one or more volatile and/or non-volatile memory elements (e.g., RAM modules, EEPROMs, Solid State Drives, look-up tables, etc.).

The electronic portion 410 of the water inlet module 400 further comprises one or more sensors 420 (e.g., flowmeters, pressure sensors—such as the pressure sensor 335 described above—, conductivity sensors, liquid level sensors, temperature sensors, etc.) preferably arranged for acquiring water/treating liquids-related information regarding water/treating liquids flowing in the hydraulic apparatus of the laundry machine 100.

It should be noted that the sensors 420 may be at least partially comprised within the hydraulic components 405*a-c* in order to acquire the water/treating liquids-related information. For example, probing/sensing terminals may be provided within valves 405*a* (as in the case of flowmeters described above with respect to the water inlet module 300), diverters 405*b* and/or pumps 405*c* in order to measure iii situ an operational parameter such as for example a flowrate, a temperature and/or a conductivity of the water/treating liquids flowing through the hydraulic components 405*a-c*.

The electronic portion 410 of the water inlet module 400 further comprises one or more Input/Output, or I/O, interfaces 425 (e.g., one or more connection circuitries featuring suitable respective or shared connection terminals) arranged for allowing the local control unit 415 managing the operation of the hydraulic components 405*a-c*.

To this extend the I/O interfaces 425 may comprise suitable wirings, actuators and/or other electric/electronic components (e.g., encoders, multiplexers, de-multiplexers, etc.) adapted to electrically connect to the hydraulic components 405*a-c* in such a way that the local control unit 315 may effectively manage the operation of the hydraulic components 405*a-c*.

Furthermore, the I/O interfaces 425 may comprise suitable wiring harness and, possibly, electric/electronic components in order to connect to one or more external elements, collectively indicated by reference 430 in FIG. 4.

The I/O interfaces 425 are preferably arranged for operatively connecting the water inlet module 400 with the control circuitry 150*a* and the power supply circuitry 150*b* of the control unit 150 of the laundry machine.

In an embodiment of the invention, I/O interfaces 425 may be arranged for operatively coupling the water inlet module 400 with one or more additional sensors 435 and/or additional hydraulic components 440 positioned afar from the water inlet module 400 (i.e., the structure comprising both the hydraulic portion 405 and the electronic portion 410).

For example, the additional sensors 435 may comprise one or more temperature sensors and or conductivity sensors (not shown in the drawings) provided in the washing tub 107 and/or a liquid leakages detection arrangement (not shown), possibly, positioned in a bottom portion of the casing 105 of the laundry machine 100.

The additional hydraulic components 440 may comprise a safety flow-arresting valve (not shown, but known in the art) generally provided in proximity of water mains connection (e.g., external to the casing 105 of the laundry machine 100) to which the laundry machine 100 is connected for receiving fresh water. The safety flow-arresting valve is generally arranged for blocking inlet flow of fresh water in case of selected failure events occurring in the laundry machine 100 (e.g., detection of a leakage of water/treating liquids).

Preferably, the water inlet module 400 is provided as a single structure in which the hydraulic portion 405 and the electronic portion 410 are substantially mechanically coupled one to the other. Even more preferably, the water inlet module 400 may comprise a frame (not shown in FIG. 4; such as the frame 340 of the water inlet module 300 described above) to which both the hydraulic portion 405 and the electronic portion 410 may be mounted.

Optionally, the water inlet module 400 may further comprise an enclosing shell (not shown) arranged for enclosing at least part of the electronic portion 410 of the water inlet module 400 yet allowing the I/O interfaces 425 to couple with hydraulic components 405*a-c* of the hydraulic portion 405 and the external elements 430.

Preferably, the enclosing shell protects at least part of the electronic portion 410 from foreign matters (e.g., dirt) and water and/or moisture.

It should be noted that the frame 340 of the water inlet module 300 described above with reference to FIG. 3, serves also as an enclosing shell for the part of the electronic board 340 that mounts the local control circuitry.

In an embodiment of the invention (not shown in the drawings), the enclosing shell is a substantially watertight enclosure, thus enhancing the protection from foreign matters (e.g., dirt) and water and/or moisture with respect to non-watertight enclosing shells.

Advantageously, the frame, or the enclosing shell if provided, may be shaped and/or provided with coupling elements, such as for example coupling appendages and/or recesses in order to allow a simple mounting of the water inlet module 400 in its position within the laundry machine 100 (e.g., the water inlet module 400 may comprise protrusions and/or receptacles suitable for snap-fitting or bayonet mounting, and/or bored tabs or hooks for fastening means such as screws).

In an embodiment of the invention, the electronic portion 410 of the water inlet module 400 is configured for managing hydraulic components 405*a-c* of the hydraulic portion 405 and, possibly, the additional hydraulic components 440 mentioned above in a manner substantially independent from the control circuitry 150*a* of the control unit 150.

Preferably, the control circuitry 150*a* of the control unit 150 of the laundry machine provides to the water inlet module 400 an indication of a laundry-treating procedure to be implemented by the laundry machine 100 (for example, previously selected by a user through the user interface 140*a*). Such indication is preferably transmitted from the control circuitry 150*a* of the control unit 150 to the water inlet module 400 as an electric, preferably digital, signal through a respective I/O interface of the I/O interfaces 425.

In an embodiment of the invention, the indication of a laundry-treating procedure is exploited by the local control circuitry 415*a* for retrieving a corresponding set of instructions from the memory circuitry 415*b* of the electronic portion 410 of the water inlet module 400.

Afterwards, the local control circuitry 415*a* selectively actuates one or more of the hydraulic components 405*a-c* of the hydraulic portion 405 and, possibly, the additional hydraulic components 440 through the I/O interfaces 425 based on the retrieved instruction set and information obtained from the sensors 420 and, possibly, the additional sensors 435.

It should be noted that, the operation of the hydraulic components 405*a-c* of the hydraulic portion 405 and, possibly, the additional hydraulic components 440, managed by the local control unit 415, may be performed in a manner completely independent from the control circuitry 150*a* of the control unit 150.

This, generally simplifies a complexity and relaxes requirements of the control unit 150 of the laundry machine 100. Indeed, thanks to the embodiments of the present invention, the control unit 159 only needs to provide the indication of a laundry-treating procedure to be implemented by the laundry machine 100 to the local control unit 415 of the water inlet module 400.

In other words, the water inlet module 400 according to the present invention can be assimilated to a 'black box' to which the control unit 150 provides the indication of a laundry-treating procedure to be implemented and from which the control unit 150 eventually receives an indication that water-related operation required by the. laundry-treating procedure has been completed and/or, possibly, alert indication (e.g., in case of water/liquid leakages detection).

This allows to design a generic control unit 150 that can be implemented in a multiplicity of laundry machine models each featuring a respective water inlet module comprising various different hydraulic components and/or local control units, since the management of the operation of such hydraulic components is performed by the local control unit comprised in the water inlet module together with such hydraulic components.

In an embodiment of the invention, the laundry machine 100 may comprise a water softening device (not shown) arranged/interposed between the water mains providing fresh water and water/treating liquid storage element (e.g., the water load chamber 272 and/or the washing tub 107 in the laundry machine 100) of the laundry machine 100 as described in the following.

During operation, the water softening device is crossed by fresh water flowing from the water mains towards the water-receiving component(s), and is structured for selectively reducing, during each washing cycle, the hardness degree of the fresh water drawn from the water mains. A detailed non-limiting example of such a water softening device may be found in the European patent No. EP 2554736 of the same Applicant which is hereby incorporated by reference.

According to invention preferred embodiment, the water inlet module 400 further comprises a conductivity sensor (among the sensors 420), which electrically connected with the local control unit 415 of the electronic portion 410. The conductivity sensor provides an indication (e.g., an electric signal) indicative of a value of the conductivity of the fresh water received from the water mains. For example, the conductivity sensor may comprise a probe arranged for measuring a water resistance of the fresh water by means a radiofrequency signal.

As known, the knowledge of the value of water conductivity may be exploiter by the local control unit 415 of the water inlet module 400 for estimating the hardness of water.

In an embodiment of the invention, the water inlet module 400 preferably comprises a valve assembly (part of the valves 405*a*) or a diverter 405*b* arranged for selectively forwarding the fresh water to the water softening device or to the water/treating liquid storage element (e.g., the water load chamber 272 and/or the washing tub 107) of the laundry machine 100.

Advantageously, the local control unit 415 of the water inlet module 400 may actuate the valves 405*a* (or the diverter 405*b*) to steer fresh water towards the water softening device or to the water-receiving components based on the estimation of the water hardness (i.e., deduced from the conductivity value). For example, the local control unit 415 may actuate the valves 405*a* (or the diverter 405*b*) for steering fresh water towards the water softening device whether the value of the conductivity falls below a conductivity threshold value (e.g., stored in the memory circuitry 415*b* of the local control unit 415).

As an addition or as an alternative, the conductivity sensor may also be exploited for identifying whether a softening resin comprised in the water softening device requires to be regenerated. For example, a probe of the conductivity sensor may be provided downstream the water softening device in order to measure the hardness of the water processed (i.e., 'softened') by the water softening device. In case the value of conductivity is below a predetermined operative threshold value (e.g., also stored in the memory circuitry 415*b* of the local control unit 415) the local control circuitry 415*a* may identify the necessity to regenerate the softening resin of the water softening device and, accordingly, may generate a corresponding (electric) signal which is issued (e.g., through a corresponding I/O interface 425) to the control unit 150 or to the user interface 140 of the laundry machine 100.

The water inlet module 400 according to the present invention may be produced as a single independent element that is subsequently mounted in the laundry machine 100 during manufacturing.

This allows a fine adjustment of the water inlet module itself, normally not achievable in the prior art where hydraulic components are provided (i.e., manufactured and mounted) as separate entities and their operation is directly managed by the control unit of the laundry machine.

Indeed, it is possible to subject the water inlet module 490 to performance tests before mounting the water inlet module in the laundry machine 100 in a simple and cost-effective manner.

Advantageously, the performance tests may assess relative errors associated with the measurement of operating parameters (e.g., pressure, flow rate, temperature, etc.) provided by the sensors 420. Preferably, corrective factors may be computed based on the results provided by the performance tests. Even more preferably, the corrective factors may be stored in the memory circuitry 415*b* of the local control unit 415 and used by the local control circuitry 415*a* in order to correct the information provided by the sensors 420 during the operation of the water inlet module 400 and, more generally, during the operation of the laundry machine 100. Therefore, the water inlet module 400 may achieve a more effective and precise operation by reducing, preferably in real-time, the effects of relative errors through the corrective factors.

The invention claimed is:

1. An appliance comprising:

a casing configured to support a tub and a rotatable drum;

a main control unit mounted in the casing and configured to manage an operation of the appliance;

a hydraulic system configured to distribute water/treating liquids within the appliance;

a plurality of sensors arranged for acquiring information regarding physical parameters associated with the operation of the appliance; and a module configured to manage at least part of the water/treating liquids distribution within the appliance, wherein the module comprises:

at least one hydraulic component of the hydraulic system, the at least one hydraulic component comprising a valve and an actuator operatively connected to the valve;

at least two sensors of the plurality of sensors;

a local control unit configured to manage an operation of the at least one hydraulic component and/or receive information acquired by the at least two sensors; and a frame supporting in an operative position, and mechanically coupling together in a single structure, the local control unit, the at least two sensors, and the at least one hydraulic component, wherein the frame comprises a main surface and at least one window passing through the main surface to an opposite side of the frame, the valve and the actuator are mounted to and extend away from the main surface; and at least one electrical connection passing through the at least one window from the actuator to the local control unit;

wherein the local control unit is separate from and in electrical communication with the main control unit; and wherein the module is configured as a single independent element that is mounted separately to the remainder of the appliance.

2. The appliance according to claim 1, wherein the valve is configured to selectively hydraulically couple a fresh water supply with a water and/or treating liquids container of the appliance.

3. The appliance according to claim 1, wherein the at least one hydraulic component further comprises:

a valve configured to selectively hydraulically couple a hot water supply with a water and/or treating liquids container of the appliance.

4. The appliance according to claim 1, further comprising:

a water softening device configured to selectively reduce a hardness degree of a fresh water supply, and wherein the at least one hydraulic component comprises:

a diverter configured to selectively hydraulically couple a fresh/hot water supply with the water softening device or to a water and/or treating liquids container.

5. The appliance according to claim 1, further comprising:

at least one container configured to store a treating liquid, and wherein the at least one hydraulic component further comprises:

at least a pump configured to selectively force a dosed amount of the treating liquid stored in the at least one container to a mixing chamber of the appliance.

6. The appliance according to claim 1, wherein the at least two sensors comprise:

a pressure sensor configured to acquire information regarding a pressure exerted by water and/or treating liquids located in a water and/or treating liquids container of the appliance.

7. The appliance according to claim 1, wherein the at least two sensors further comprise at least one among:

a flow rate sensor configured to acquire information regarding an amount of water that passes through the at least one hydraulic component, and a conductivity sensor configured to acquire information regarding a conductivity of the water that passes through the at least one hydraulic component.

8. The appliance according to claim 1, wherein the local control unit of the module comprises:

a memory circuitry storing at least one set of instructions configured to, when implemented, manage the operation of the at least one hydraulic component, and a local control circuitry configured to implement the at least one set of instructions to manage the operation of the at least one hydraulic component based on the information acquired by the at least two sensors.

9. The appliance according to claim 1, wherein the local control unit of the module is implemented on an electronic board.

10. The appliance according to claim 9, wherein the at least two sensors are at least partly implemented on the electronic board.

11. The appliance according to claim 1, wherein:

the local control unit of the module is implemented on an electronic board; and the frame supports the local control unit and the at least two sensors by supporting the electronic board on which the local control unit and the at least two sensors are implemented.

12. The appliance according to claim 11, further comprising an enclosing shell at least partly enclosing the electronic board and configured to protect the electronic board from foreign matters and water and/or moisture.

13. The appliance according to claim 1, wherein the module is operatively coupled with:

at least one external hydraulic component provided in the casing separate from the module, and/or at least one external sensor provided in the casing separate from the module, and wherein the local control unit is configured for managing an operation of the at least one external hydraulic component and/or receiving information acquired by the least one external sensor.

14. The appliance according to claim 13, wherein the at least one external sensor comprises:

a temperature sensor configured to acquire a temperature information of water/treating liquids in a water and/or treating liquids container of the appliance.

15. The appliance according to claim 2, wherein the water and/or treating liquids container comprises a water load chamber or a washing tub.

16. The appliance according to claim 1, wherein the valve has an outlet port extending in a direction away from the main surface; and the at least two sensors comprises a pressure sensor having a protruding probing portion extending in the direction away from the main surface.

17. The appliance according to claim 16, wherein the at least one hydraulic component comprises another valve mounted to the main surface, each of the two valves having a respective outlet port extending in the direction away from the main surface.

18. The appliance according to claim 1, wherein:

the main surface has at least one rail extending along the main surface; and the at least one hydraulic component is mounted to the main surface via the at least one rail.

19. The appliance according to claim 18, wherein the at least one hydraulic component is snap fit to the at least one rail.

20. The appliance according to claim 18, wherein:

the actuator is connected to the least one rail and extends in a first direction from the main surface; and the valve is connected to the actuator and extends from the actuator in a second direction that is perpendicular to the first direction.

21. The appliance according to claim 18, wherein the valve and the actuator are mounted as a first valve and actuator assembly to the at least one rail, and a second valve and actuator assembly is mounted to the at least one rail adjacent to the first valve and actuator assembly.

22. The appliance according to claim 18, wherein:

the at least one rail comprises two rails extending in parallel along the main surface; and at least one window is located between the two rails.

* * * * *